US008655235B2

(12) United States Patent
Itabashi

(10) Patent No.: US 8,655,235 B2
(45) Date of Patent: Feb. 18, 2014

(54) TONER CARTRIDGE

(75) Inventor: Nao Itabashi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 217 days.

(21) Appl. No.: 13/196,953

(22) Filed: Aug. 3, 2011

(65) Prior Publication Data

US 2012/0057906 A1 Mar. 8, 2012

(30) Foreign Application Priority Data

Sep. 7, 2010 (JP) ..... 2010-200188

(51) Int. Cl.
*G03G 15/08* (2006.01)

(52) U.S. Cl.
USPC ..... 399/262; 399/101; 399/102; 399/103; 399/105; 399/106; 399/258

(58) Field of Classification Search
USPC ..... 399/101, 102, 105, 106, 258, 262
See application file for complete search history.

(56) References Cited

U.S. PATENT DOCUMENTS

| | | | | |
|---|---|---|---|---|
| 7,881,633 | B2 * | 2/2011 | Sakuma | 399/106 |
| 2008/0267658 | A1 | 10/2008 | Takagi et al. | |
| 2010/0272465 | A1 * | 10/2010 | Yamazaki | 399/106 |

FOREIGN PATENT DOCUMENTS

| | | | |
|---|---|---|---|
| JP | 07-199657 | A | 8/1995 |
| JP | 8-152782 | A | 6/1996 |
| JP | 08-160730 | A | 6/1996 |
| JP | 08-292635 | A | 11/1996 |
| JP | 11-153904 | A | 6/1999 |
| JP | 11-282237 | A | 10/1999 |
| JP | 2000-181209 | A | 6/2000 |
| JP | 2001-005273 | A | 1/2001 |
| JP | 2001-005723 | A | 1/2001 |
| JP | 2002-214906 | A | 7/2002 |
| JP | 2005-031229 | A | 2/2005 |
| JP | 2007-333875 | A | 12/2007 |
| JP | 2008-275874 | | 11/2008 |
| JP | 2009-186547 | A | 8/2009 |

OTHER PUBLICATIONS

JP Office Action dtd Nov. 27, 2012, JP Appln. 2010-200188, English translation.

Office Action received in corresponding JP Application No. 2010-200188 on Sep. 11, 2012.

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A toner cartridge includes: a main body; a shutter; a toner seal; and a shift member. The main body defines an internal space for accommodating toner and formed with a communication hole, through which an interior and an exterior of the main body communicate. The shutter is movable between an open position in which the communication hole is open and a closed position in which the communication hole is closed. The shutter is also shiftable between a first position in which the shutter is positioned away from the main body and a second position in which the shutter is positioned close to the main body. The toner seal is disposed between the main body and the shutter when the shutter is in the closed position. The shift member is configured to shift the shutter from the first position to the second position when the shutter is in the closed position.

10 Claims, 10 Drawing Sheets

TONER CARTRIDGE

CROSS REFERENCE TO RELATED APPLICATION

This application claims priority from Japanese Patent Application No. 2010-200188 filed Sep. 7, 2010. The entire content of the priority application is incorporated herein by reference.

TECHNICAL FIELD

The present invention relates to a toner cartridge that is mounted in an image forming device such as a color printer.

BACKGROUND

A conventional laser printer has a main casing, and, within the main casing, a process cartridge retaining a photosensitive drum and a developing roller is detachably mounted. A toner cartridge in which toner is accommodated is mounted in the process cartridge.

The photosensitive drum and the developing roller are disposed in the process cartridge such that a circumferential surface of the photosensitive drum is in contact with a circumferential surface of the developing roller. The process cartridge has a curved partitioning wall at a position opposite the photosensitive drum relative to the developing roller. The partitioning wall is formed so as to conform to an outer shape of the toner cartridge. The process cartridge is further provided with a cartridge accommodating portion for accommodating the toner cartridge at a position opposite the photosensitive drum and the developing roller relative to the partitioning wall. The cartridge accommodating portion includes a shutter movable along the partitioning wall. The partitioning wall is formed with frame-side passing ports penetrating the partitioning wall. The partitioning wall has a surface confronting the shutter, and annular frame seals are affixed to the surface. Each annular frame seal encircles a perimeter of the frame-side passing port.

The toner cartridge includes an inner casing for accommodating toner and an outer casing for movably accommodating the inner casing. The inner casing has a circumferential wall formed with inner-casing passing ports. The inner casing has an outer circumferential surface provided with toner seals so that each toner seal encircles a perimeter of the inner-casing passing port. The outer casing has a circumferential wall formed with outer-casing passing ports at positions corresponding to the inner-casing passing ports. When an inner circumferential surface of the outer casing confronts the inner-casing passing ports, the inner-casing passing ports are closed by the outer casing.

When the toner cartridge is mounted in the cartridge accommodating portion, the toner cartridge is moved downward toward the cartridge accommodating portion while the inner-casing passing ports are closed by the outer casing. When the toner cartridge has been accommodated in the cartridge accommodating portion, the toner cartridge is pressed toward the partitioning wall. Then, the shutter and the inner casing are integrally moved, so that the inner-casing passing ports are brought into confrontation with the frame-side passing ports through the outer-casing passing ports. Hence, a space in which the developing roller is accommodated communicates with the interior of the toner cartridge (the interior of the inner casing) while the inner casing and the outer casing are sealed by the toner seals and the outer casing and the partitioning wall are sealed by the frame seals.

SUMMARY

The toner seal must have relatively high seal pressure in order to prevent toner leakage during transportation of the toner cartridge. However, if the toner seal has high seal pressure, torque necessary for relatively moving the outer casing and the inner casing increases, thereby degrading operability of the toner cartridge when the outer casing and the inner casing are relatively moved.

In view of the foregoing, it is an object of the present invention to provide a toner cartridge capable of reducing torque necessary for moving a shutter while preventing toner leakage at the time of transportation.

In order to attain the above and other objects, the present invention provides a toner cartridge including: a main body; a shutter; a toner seal; and a shift member. The main body defines an internal space for accommodating toner and formed with a communication hole, through which an interior and an exterior of the main body communicate. The shutter is movable between an open position in which the communication hole is open and a closed position in which the communication hole is closed. The shutter is also shiftable between a first position in which the shutter is positioned away from the main body and a second position in which the shutter is positioned close to the main body. The toner seal is disposed between the main body and the shutter when the shutter is in the closed position. The shift member is configured to shift the shutter from the first position to the second position when the shutter is in the closed position.

BRIEF DESCRIPTION OF THE DRAWINGS

The particular features and advantages of the present invention as well as other objects will become apparent from the following description taken in connection with the accompanying drawings, in which.

DETAILED DESCRIPTION

Next, a toner cartridge according to a first embodiment of the present invention will be described while referring to FIGS. 1 to 6B.

1. Structure of Color Printer

Figure 1:
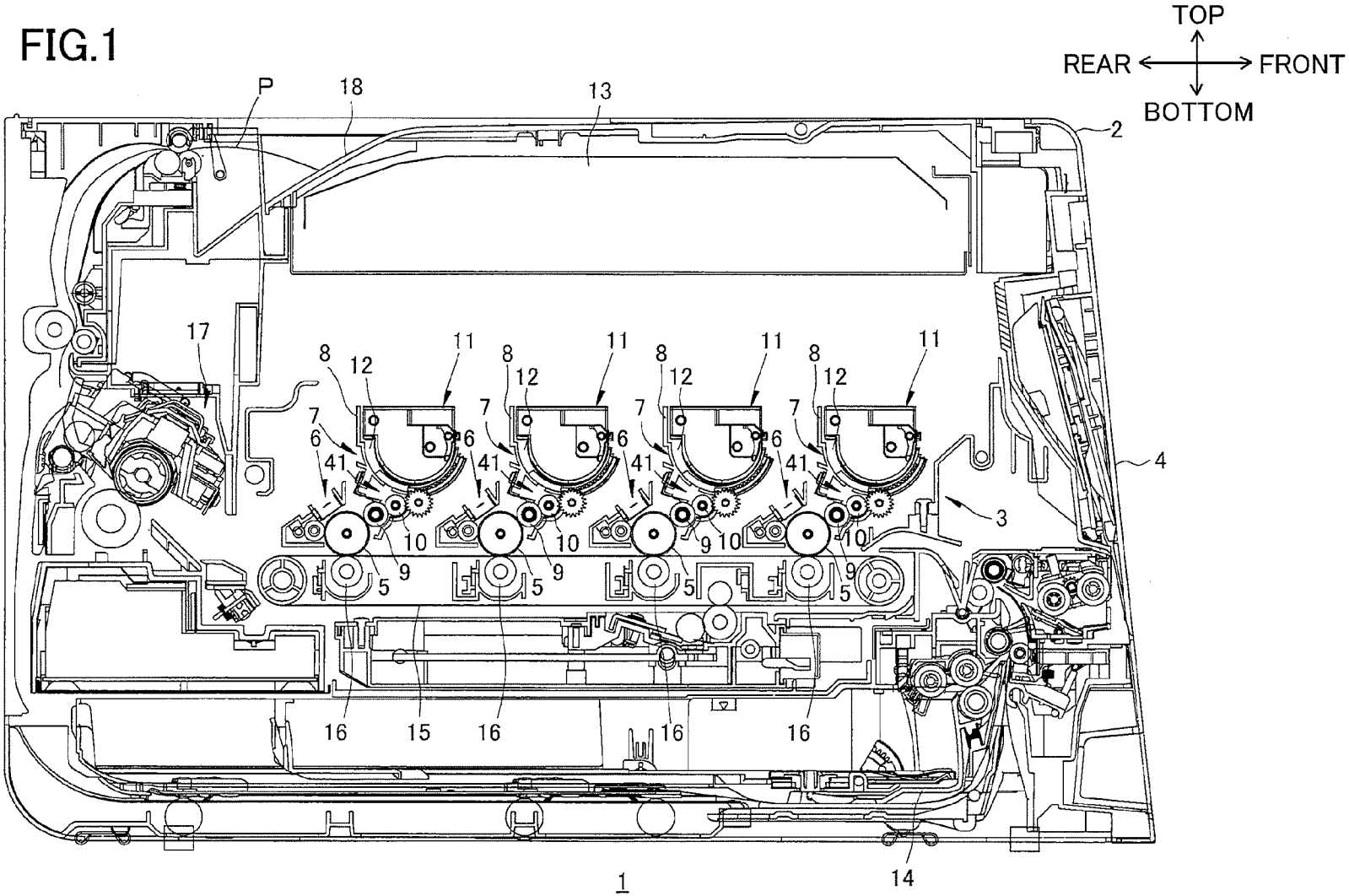
FIG. 1 is a cross-sectional view of a color printer in which a toner cartridge according to a first embodiment of the present invention is mounted.

As shown in FIG. 1, an image forming device provided with a toner cartridge according to the embodiment is a tandem-type color printer 1. As shown in FIG. 1, the color printer 1 includes a main casing 2. A drawer unit 3 is mounted inside the main casing 2. The main casing 2 has a front portion at which a front cover 4 is provided. The front cover 4 is movable between an open position and a closed position. When the front cover 4 is in the open position, the drawer unit 3 can be moved horizontally between an accommodated position inside the main casing 2 (a position shown in FIG. 1) and a pulled-out position outside the main casing 2. When the drawer unit 3 is in the pulled-out position, a part of the drawer unit 3 remains inside the main casing 2 while a space defined above four toner cartridges 11 (described later) that are mounted in the drawer unit 3 is exposed to atmosphere. That is, when the drawer unit 3 is in the pulled-out position, the drawer unit 3 is not detached from the main casing 2, but still supported to the main casing 2.

The terms "upward", "downward", "upper", "lower", "above", "below", "right", "left", "front", "rear" and the like will be used throughout the description assuming that the color printer 1 is disposed in an orientation in which it is intended to be used. In the following description, a side of the color printer 1 on which the front cover 4 is provided (right side in FIG. 1) will be referred to as a front side of the color printer 1. Top, bottom, left, and right sides of the color printer 1 in the following description will be based on the reference point of a user viewing the color printer 1 from the front side. Directions related to the drawer unit 3 and the toner cartridge 11 that is mounted in the drawer unit 3 will be referred as if the drawer unit 3 and the toner cartridge 11 had been mounted in the main casing 2, unless otherwise specified.

The drawer unit 3 includes a drawer frame (described later but not shown) installing four photosensitive drums 5, four chargers 6, and four developing units 7.

As shown in FIG. 1, the four photosensitive drums 5 are rotatably retained in the drawer unit 3. The photosensitive drums 5 are rotatable about axes extending in a left-to-right direction. The four photosensitive drums 5 are respectively provided for the colors black, yellow, magenta, and cyan. The photosensitive drums 5 are arranged parallel to each other at regular intervals in a front-to-rear direction in the order black, yellow, magenta, and cyan from the front.

The four chargers 6 are also retained in the drawer unit 3. The chargers 6 have a one-on-one correspondence to the four photosensitive drums 5 and are disposed diagonally above and rearward of the corresponding photosensitive drums 5. Each charger 6 is a Scorotron charger that includes a discharge wire and a grid, for example.

The four developing units 7 are also retained in the drawer unit 3. The four developing units 7 also have a one-on-one correspondence to the four photosensitive drums 5, and are disposed diagonally above and forward of the corresponding photosensitive drums 5.

Each developing unit 7 includes a developing unit frame 8. Each developing unit frame 8 accommodates a developing roller 9 and a supply roller 10. The developing roller 9 is disposed so as to contact the photosensitive drum 5 and is rotatable about an axis extending in the left-to-right direction. The supply roller 10 is disposed diagonally above and forward of the developing roller 9 so as to contact the developing roller 9 and is rotatable about an axis extending in the left-to-right direction.

A space 12 is defined in the drawer unit 3 above each developing unit 7. The toner cartridge 11 that accommodates toner is mounted in the space 12. Sufficient free space above the drawer unit 3 is acquired for mounting the toner cartridges 11 in the spaces 12 by pulling the drawer unit 3 outward to the pulled-out position. The toner cartridges 11 are adapted to supply toner to the corresponding developing units 7.

An exposure unit 13 is provided in the main casing 2 above the drawer unit 3. The exposure unit 13 is adapted to irradiate four laser beams corresponding to the four colors used by the color printer 1.

As each photosensitive drum 5 rotates, the corresponding charger 6 applies a uniform charge to the surface of the photosensitive drum 5. Subsequently, the exposure unit 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of the photosensitive drum 5 rotates to a position opposite the corresponding developing roller 9, the developing roller 9 supplies toner to the electrostatic latent image, thereby forming a toner image on the surface of the photosensitive drum 5. Four LED arrays may be provided for the four photosensitive drums 5 in place of the exposure unit 13.

A sheet supply cassette 14 accommodating sheets of paper P is disposed at a bottom section of the main casing 2. Each sheet P accommodated in the sheet supply cassette 14 is conveyed onto a conveying belt 15 by various rollers. The conveying belt 15 confronts the four photosensitive drums 5 from below. Four transfer rollers 16 are disposed inside the conveying belt 15 at positions confronting the photosensitive drums 5 through an upper portion of the conveying belt 15. When the sheet P is conveyed onto the conveying belt 15, the conveying belt 15 carries the sheet P sequentially to positions between the conveying belt 15 and each of the photosensitive drums 5. As the sheet P passes beneath each photosensitive drum 5, the toner image carried on the surface of the photosensitive drum 5 is transferred onto the sheet P.

A fixing unit 17 is provided at a position downstream of the conveying belt 15 with respect to a direction that the sheet P is conveyed. After toner images are transferred onto the sheet P, the sheet P is conveyed to the fixing unit 17, where the toner images are fixed to the sheet P by heat and pressure. After the toner images have been fixed in the fixing unit 17, various rollers discharge the sheet P onto a discharge tray 18 provided on a top surface of the main casing 2.

2. Developing Unit

The drawer unit 3 includes the drawer frame (not shown) that is formed in a square-shape in a plan view. The drawer frame is configured of a pair of left and right side plates arranged parallel to each other and in confrontation with each other in the left-to-right direction. The respective groups of four photosensitive drums 5, chargers 6, and developing units 7 are all held together between side plates on the left and right sides thereof.

The developing unit frames 8 are disposed at regular intervals in the front-to-rear direction. Each of the spaces 12 is provided for mounting the toner cartridge 11 and is defined above the corresponding developing unit frame 8.

A developing chamber 41 is defined by each developing unit frame 8 for accommodating the developing roller 9. The developing chamber 41 has an open side opposing the corresponding photosensitive drum 5. The developing roller 9 is disposed in the bottom of the developing chamber 41 near the open side thereof.

Figure 2:
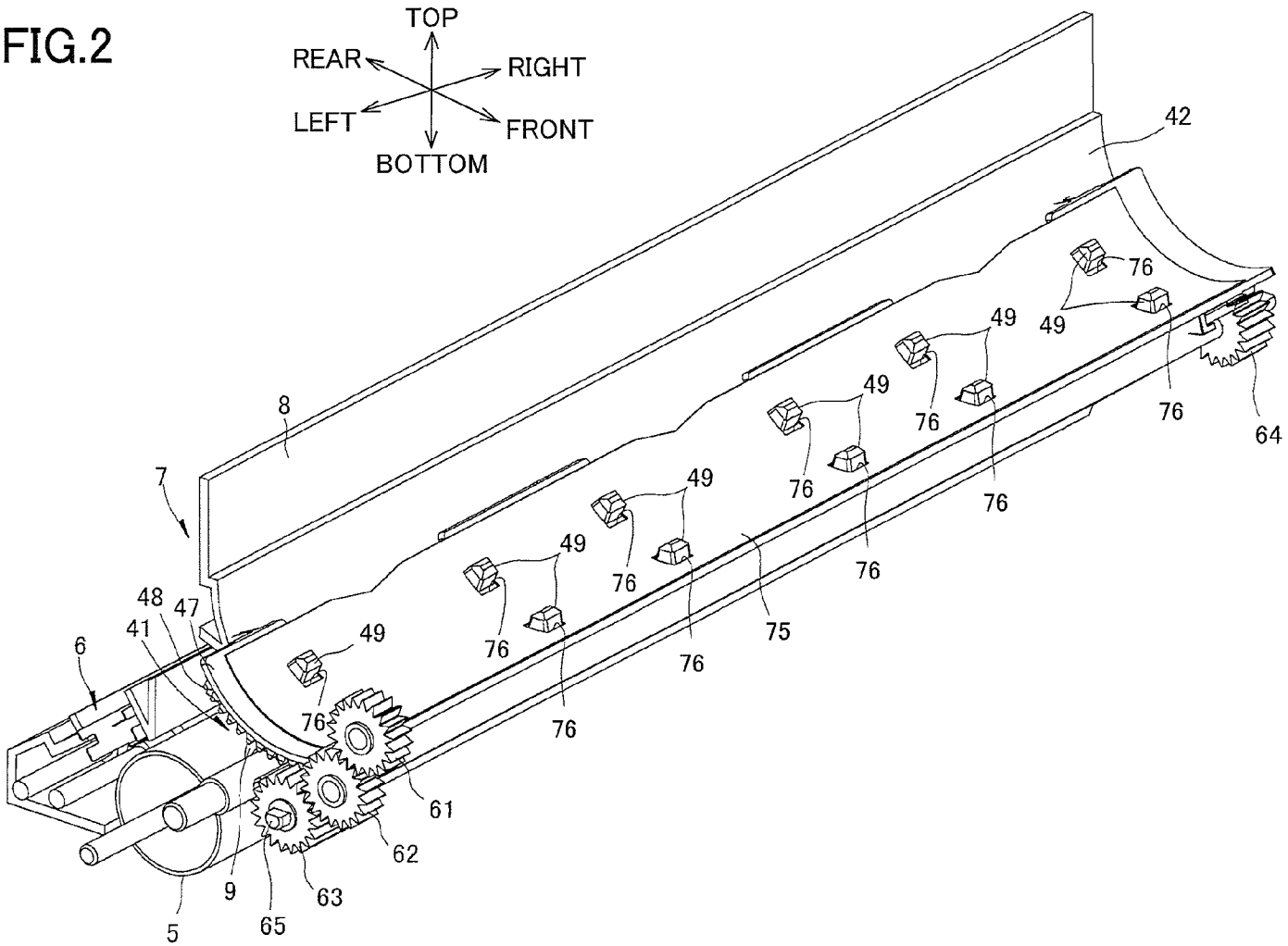
FIG. 2 is a perspective view of a photosensitive drum, a charger, and a developing unit shown in FIG. 1, wherein communication holes formed in a partitioning wall are closed.
Figure 3:
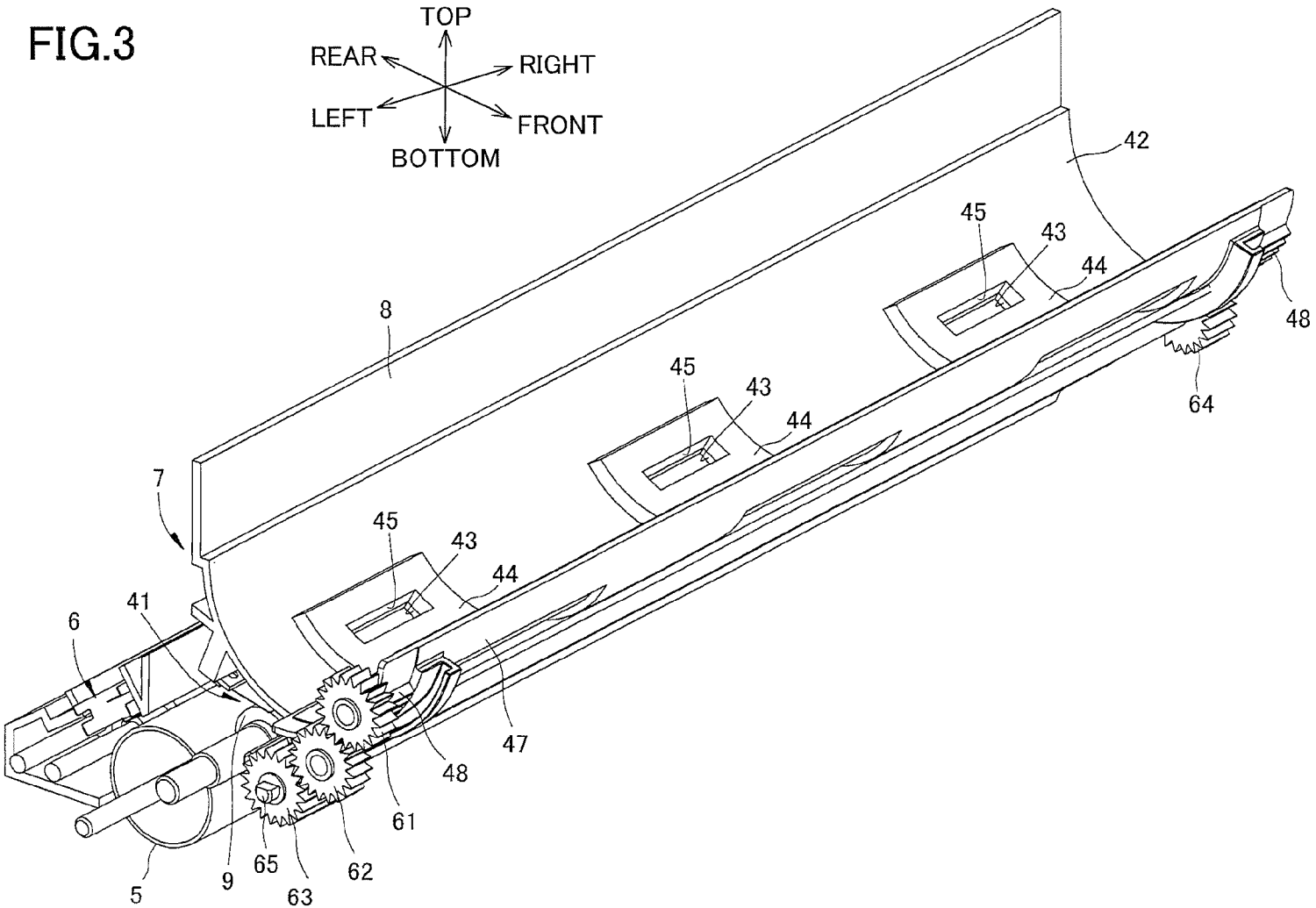
FIG. 3 is a perspective view of the photosensitive drum, the charger, and the developing unit shown in FIG. 1, wherein the communication holes formed in the partitioning wall are open.

As shown in FIGS. 2 and 3, the developing unit frame 8 also has a plate-shaped partitioning wall 42 that defines a boundary between the developing chamber 41 and the space 12. The partitioning wall 42 curves in an arc shape with its convex side facing the developing chamber 41. The partitioning wall 42 partitions the interior of the developing unit frame 8 into the developing chamber 41 and the space 12 formed above the developing chamber 41.

As shown in FIG. 3, three rectangular communication holes 43 are formed in a circumferential center of the partitioning wall 42. The communication holes 43 are formed at positions opposing three cartridge communication holes 56 (FIG. 4B) formed in the toner cartridge 11 when the toner cartridge 11 is mounted in the space 12.

Three frame seals 44 are disposed on the partitioning wall 42. Each of the frame seals 44 is provided for each communication hole 43. The frame seals 44 are affixed to the partitioning wall 42. Each frame seal 44 is formed of a foamed elastic material, and has a rectangular sheet-like form. The frame seal 44 has a center portion formed with a seal opening 45 that provides communication with the communication hole 43. The seal opening 45 penetrates the frame seal 44 in a thickness direction thereof.

3. Shutter Drive Member

As shown in FIGS. 2 and 3, a shutter drive member 47 is movably disposed above the partitioning wall 42 for driving a shutter 75 described later. The shutter drive member 47 is movable in the front-to-rear direction. The shutter drive member 47 is formed into an arcuate plate shaped, with the convex side facing the developing chamber 41. The arcuate shape of the shutter drive member 47 substantially conforms to the shape of the partitioning wall 42. The shutter drive member 47 is elongated in the left-to-right direction, and has left and right end portions respectively protruding from left and right edges of the partitioning wall 42. Further, each of the left and right end portions of the shutter drive member 47 respectively protruding from the left and right edges of the partitioning wall 42 has a bottom surface provided with a rack gear 48. That is, the left rack gear 48 is provided at the left end portions of the shutter drive member 47 and the right rack gear 48 is provided at the right end portions of the shutter drive member 47. The shutter drive member 47 has a top surface provided with shutter drive protrusions 49 at positions corresponding to shutter drive openings 76 described later. Note that FIG. 2 illustrates a state that the shutter 75 (described later) has been engaged with the shutter drive member 47.

4. Toner Cartridge (1) Casing

Figure 4A:
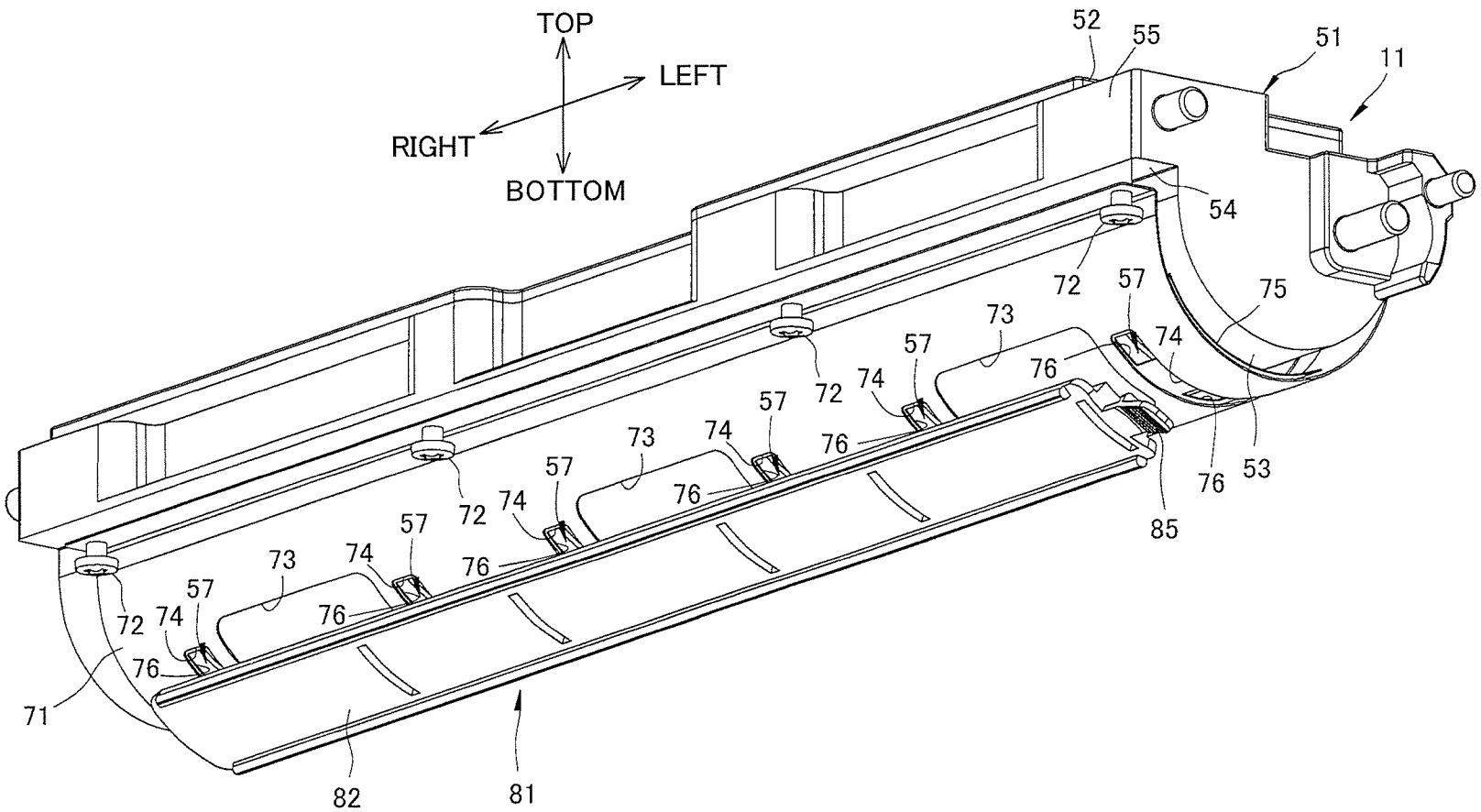
FIG. 4A is a perspective view of the toner cartridge shown in FIG. 1 and a shift member, wherein the shift member is removed from the toner cartridge.
Figure 4B:
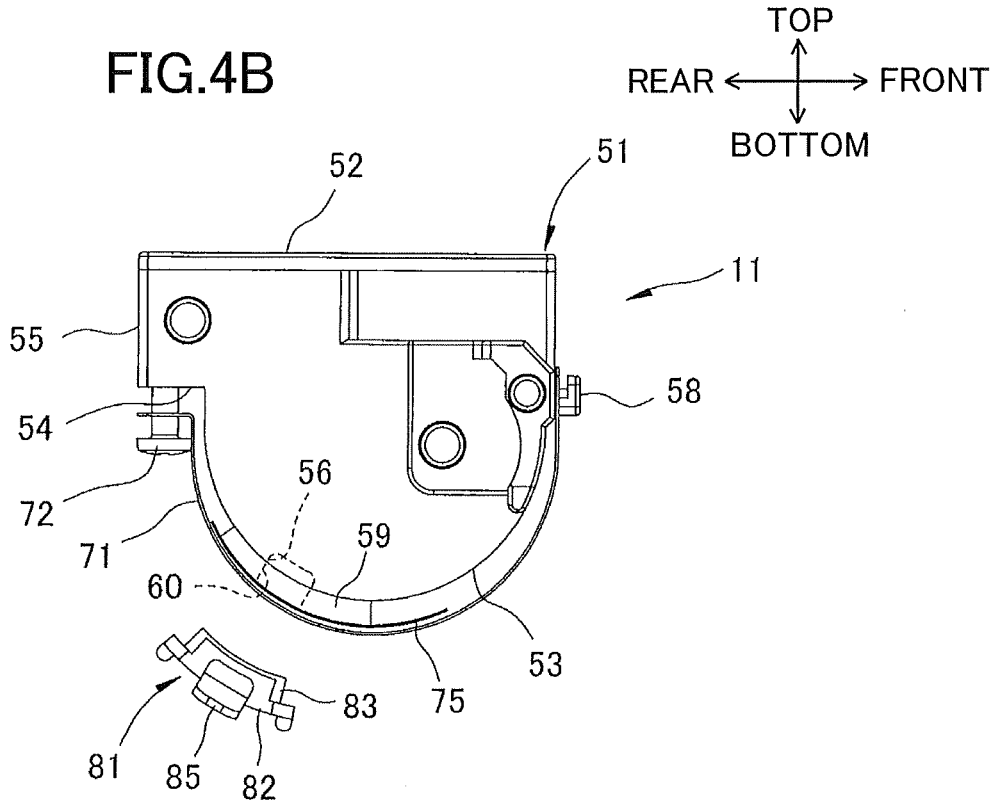
FIG. 4B is a left side view of the toner cartridge and the shift member shown in FIG. 4A.

As shown in FIGS. 4A and 4B, the toner cartridge 11 includes a casing 51 defining an internal space for accommodating toner. The casing 51 is formed of resin in a substantially hollow semicircular column shape and is elongated in the left-to-right direction. The casing 51 includes a rectangular top surface 52, an arcuate surface 53, a fixing surface 54, and a rear surface 55. The top surface 52 is elongated in the left-to-right direction. The arcuate surface 53 is connected to a front edge of the top surface 52 and has a substantially semicircular shape in a cross-section with a convex side facing downward. The fixing surface 54 extends parallel to the top surface 52 and protrudes rearward from a rear edge of the arcuate surface 53. The rear surface 55 bridges between a rear edge of the top surface 52 and a rear edge of the fixing surface 54.

As indicated by a broken line in FIG. 4B, the arcuate surface 53 is formed with the three cartridge communication holes 56 at positions slightly rearward of a lowest end thereof. The cartridge communication holes 56 are rectangular in shape, elongated in the left-to-right direction, and spaced at intervals in the left-to-right direction. The cartridge communication holes 56 provide communication between the interior and exterior of the casing 51.

Further, the arcuate surface 53 is formed with narrow slit-shaped grooves 57 (FIG. 4A). The grooves 57 extend in a circumferential direction of the arcuate surface 53 and are formed one on each of left and right sides of each cartridge communication hole 56.

The arcuate surface 53 has a front edge portion on which a plurality of positioning protrusions 58 is formed. The positioning protrusions 58 are spaced at intervals in the left-to-right direction. As shown in FIG. 4B, each positioning protrusion 58 has a hook shape, extending forward, then bending and extending upward.

(2) Toner Seal

As shown in FIG. 4B, three toner seals 59 are affixed to the arcuate surface 53. Each of the toner seals 59 is provided for each cartridge communication hole 56. The toner seal 59 is formed of a foamed elastic material. The toner seal 59 is formed in a rectangular shape and has a sheet-like form. As indicated by a broken line shown in FIG. 4B, the toner seal 59 has a center portion formed with a seal opening 60 that provides communication with the cartridge communication hole 56. The seal opening 60 penetrates the toner seals 59 in a thickness direction thereof.

(3) Shutter Cover

As shown in FIGS. 4A and 4B, a shutter cover 71 is disposed so as to cover the arcuate surface 53. The shutter cover 71 is formed of a thin metal plate, for example. The shutter cover 71 is resiliently deformable, and curved along the arcuate surface 53. As shown in FIG. 4A, the shutter cover 71 has a width substantially equal to a width of the arcuate surface 53 in the left-to-right direction. Thus, the shutter cover 71 covers the arcuate surface 53 across substantially the entire width in the left-to-right direction.

The shutter cover 71 has a front end portion formed with a plurality of positioning openings (not shown) spaced at intervals in the left-to-right direction. As shown in FIG. 4B, the positioning protrusions 58 formed on the arcuate surface 53 of the casing 51 are engaged with the positioning openings. More specifically, the positioning openings are formed in the front end portion of the shutter cover 71 and are arrayed in the left-to-right direction corresponding to the positioning protrusions 58. Further, the positioning openings are formed of a sufficient size for inserting the positioning protrusions 58. After the positioning protrusions 58 are inserted into the corresponding positioning openings, top edges of the positioning openings engage the positioning protrusions 58.

The shutter cover 71 has a rear end portion folded back to conform to the fixing surface 54 of the casing 51. A plurality of screws 72 is inserted into the rear end portion of the shutter cover 71 with a gap between the fixing surface 54 and the rear end portion of the shutter cover 71. By controlling screwing amount of the screws 72 into the fixing surface 54 of the casing 51, the shutter cover 71 is attached to the casing 51 in such a state that the rear end portion of the shutter cover 71 is movable closer to or farther from the fixing surface 54 of the casing 51.

Further, as shown in FIG. 4A, the shutter cover 71 is formed with three shutter cover openings 73 at positions corresponding to the three toner seals 59. Each of the shutter cover openings 73 has a rectangular shape and is elongated in the left-to-right direction. Further, the shutter cover opening 73 has an open area greater than that of the cartridge communication hole 56 so as to expose the cartridge communication hole 56 in its entirety and a portion of the toner seal 59 surrounding the cartridge communication hole 56.

Further, the shutter cover 71 is formed with guide slits 74 elongated in the front-to-rear direction (circumferential direction of the shutter cover 71) at positions corresponding to the grooves 57 formed in the casing 51. Each guide slit 74 confronts the corresponding groove 57 in its entirety.

(4) Shutter

As shown in FIGS. 4A and 4B, the shutter 75 is interposed between the arcuate surface 53 and the shutter cover 71 so as to be movable along the arcuate surface 53 between an open position in which the cartridge communication holes 56 are open and a closed position in which the cartridge communication holes 56 are closed. The shutter 75 is formed of a resilient material, for example, a resin film. The shutter 75 curves in conformance with a curvature of the arcuate surface 53 of the casing 51. The shutter 75 has a dimension along the circumferential direction of the arcuate surface 53 greater than that of the toner seal 59. The shutter 75 has a dimension (width) in the left-to-right direction slightly smaller than that of the arcuate surface 53.

The shutter 75 is formed with two shutter drive openings 76 separated by a prescribed interval in a circumferential direction of the shutter 75 at positions opposing each groove 57 formed in the casing 51. The distance between the two shutter drive openings 76 aligned in the circumferential direction of the shutter 75 is set such that all shutter drive openings 76 confront the corresponding grooves 57 and confront and communicate with the corresponding guide slits 74 formed in the shutter cover 71, regardless of whether the shutter 73 is in the open position or the closed position.

When the shutter 75 is in the open position, a rear edge of the shutter 75 is positioned farther forward of front edges of the seal openings 60 formed in the toner seals 59. Therefore, the cartridge communication holes 56 formed in the casing 51 and the seal openings 60 of the toner seals 59 are made open, while being in communication between the cartridge communication holes 56 and the shutter cover openings 73 formed in the shutter cover 71. This provides communication between the interior and exterior of the casing 51.

On the other hand, in the closed position, the shutter 75 is positioned farther rearward than the open position. When the shutter 75 is in the closed position, the rear edge of the shutter 75 is positioned rearward from rear edges of the seal openings 60 formed in the toner seals 59. As a result, the shutter 75 covers the cartridge communication holes 56 formed in the casing 51 and the seal openings 60 formed in the toner seals 59 in their entirety, blocking communication between the interior and exterior of the casing 51.

5. Drive Force Transmission Mechanism

Within the drawer frame (not shown), a plurality of drive force transmission mechanisms each corresponding to each shutter drive member 47 is provided. Each drive force transmission mechanism functions to transmit a drive force to the corresponding shutter drive member 47.

Although it is not shown, four operation levers are provided at a left side (outer side) of the left side plate of the drawer frame. Each operation lever is fixed to a pivot shaft that penetrates the left side plate and extends in the left-to-right direction. Each pivot shaft is pivotally movably supported to the left side plate of the drawer frame.

As shown in FIGS. 2 and 3, each drive force transmission mechanism includes a first gear 61, a second gear 62, a first pinion gear 63, a second pinion gear 64, and a connecting shaft 65. The first gear 61 is fixed to the pivot shaft at a position inward of the drawer frame. The second gear 62 is meshedly engaged with the first gear 61. The first pinion gear 63 is meshedly engaged with the second gear 62 and the left rack gear 48 of the shutter drive member 47. The second pinion gear 64 is meshedly engaged with the right rack gear 48 of the shutter drive member 47. The connecting shaft 65 provides connection between the first pinion gear 63 and the second pinion gear 64.

When the operation member is operated, the first gear 61 rotates to transmit a rotational force to the second gear 62 from the first gear 61. The rotational force transmitted to the second gear 62 is further transmitted to the first pinion gear 63 from the second gear 62. As a result, the first pinion gear 63 and the second pinion gear 64 rotate, thereby transmitting a rotational force of the first pinion gear 63 to the left rack gear 48 as well as transmitting a rotational force of the second pinion gear 64 to the right rack gear 48. With this configuration, the shutter drive member 47 moves in the front-to-rear direction along the partitioning wall 42, and, in association with the movement of the shutter drive member 47, the shutter 75 moves between the open position and the closed position.

6. Opening and Closing Shutter (1) Movement of Shutter to Open Position from Closed Position When the toner cartridge 11 has been removed from the drawer unit 3, the shutter 75 is in the closed position. When the toner cartridge 11 is mounted in the space 12, each of the shutter drive protrusions 49 is brought into engagement with the corresponding shutter drive opening 76 formed in the shutter 75 through the corresponding guide slit 74 formed in the shutter cover 71. Hence, engagement of the shutter drive member 47 with the shutter 75 can be achieved.

After the toner cartridge 11 has been mounted in the space 12, the operation lever (not shown) is operated to move the shutter 75 to the open position from the closed position. This operation allows the first gear 61 to rotate in a clockwise direction as viewed from a left side. A rotational force of the first gear 61 is transmitted to the rack gears 48 of the shutter drive member 47. As a result, the shutter drive member 47 moves forward to a position not confronting the communication holes 43 formed in the partitioning wall 42 from a position confronting the communication holes 43. In association with the forward movement of the shutter drive member 47, the shutter 75 moves forward from the closed position to the open position.

(2) Movement of Shutter to Closed Position from Open Position

For moving the shutter 75 to the closed position from the open position, the operation lever (not shown) is operated in a reverse direction when moving the shutter 75 to the open position from the closed position. This operation allows the first gear 61 to rotate in a counterclockwise direction as viewed from the left side. A rotational force of the first gear 61 is transmitted to the rack gears 48 of the shutter drive member 47. As a result, the shutter drive member 47 moves rearward, and, in association with the rearward movement of the shutter drive member 47, the shutter 75 moves rearward from the open position to the closed position.

7. Shift Member

As shown in FIGS. 4A and 4B, the toner cartridge 11 is accompanied with a shift member 81 for shifting the shutter 75 in the closed position between a first position and a second position. In the first position, the shutter 75 is positioned relatively far from the casing 51. In the second position, the shutter 75 is positioned relatively close to the casing 51. The shift member 81 is attachable to or detachable from the toner cartridge 11.

Figure 5:
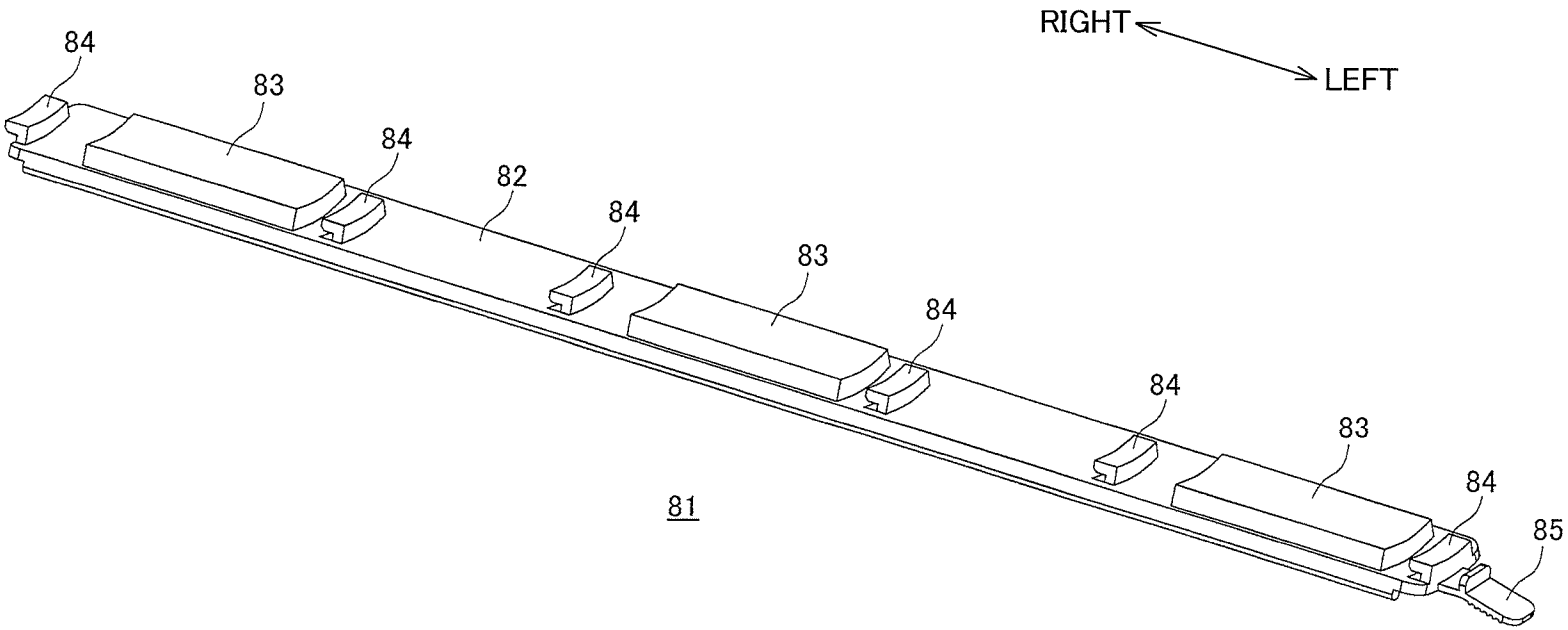
FIG. 5 is a perspective view of the shift member shown in FIG. 4A.

As shown in FIG. 5, the shift member 81 includes a base portion 82, three pressure portions 83, six holding portions 84, and a pinching portion 85. The base portion 82 is formed in an elongated plate shape. The base portion 82 is curved with a curvature substantially equal to a curvature of an outer circumference of the shutter cover 71 so as to conform to an outer circumferential shape of the shutter cover 71.

The base portion 82 has a curved surface facing the shutter cover 71 of the toner cartridge 11 when the shift member 81 is attached to the toner cartridge 11. The curved surface of the base portion 82 is provided with the three pressure portions 83. The three pressure portions 83 are arranged at intervals equal to those of the three shutter cover openings 73 formed in the shutter cover 71. Each of the pressure portions 83 is formed in a rectangular shape with a dimension insertable into the shutter cover opening 73. The pressure portion 83 is formed of a material whose resilient deformation is lower than that of the toner seal 59.

Further, the six holding portions 84 are formed in the curved surface of the base portion 82. The holding portions 84 are formed one on each of the left and right sides of each pressure portion 83. In other words, the holding portions 84 are spaced at intervals equal to those of the six guide slits 74 formed in the shutter cover 71. Each of the holding portions 84 upstands from the curved surface, and then, bends rightward, so as to form an L-shape.

The pinching portion 85 is provided at a left edge of the base portion 82. The pinching portion 85 extends from the left edge of the base portion 82 in a direction opposite to a direction that the holding portions 84 are bent.

Figure 6A:
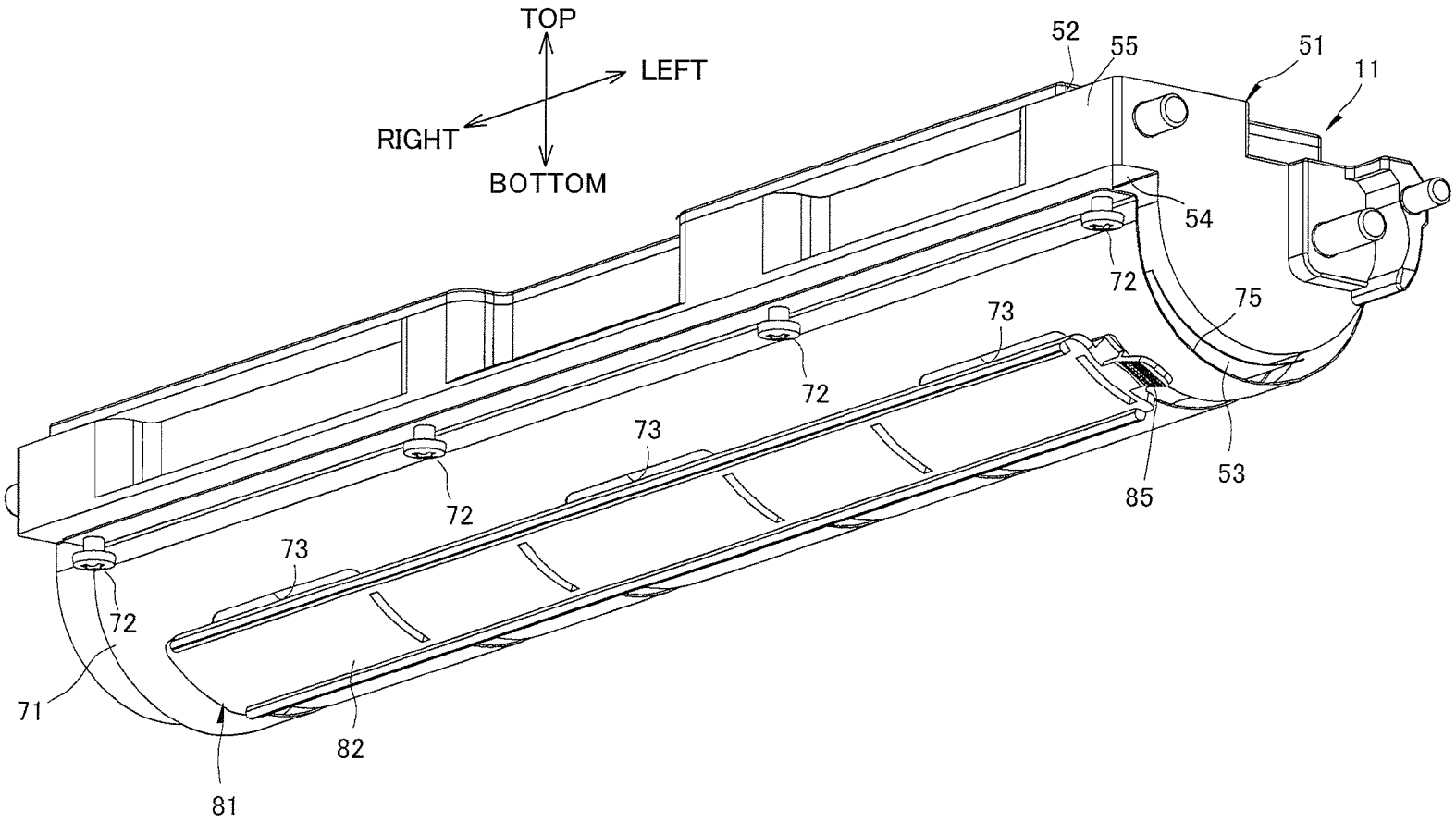
FIG. 6A is a perspective view of the toner cartridge and the shift member shown in FIG. 4A, wherein the shift member is attached to the toner cartridge.

The shift member 81 is attached to the toner cartridge 11 that has been removed from the space 12 (FIG. 1). That is, as shown in FIGS. 4A and 4B, the shift member 81 is arranged in such a position that the base portion 82 confronts the shutter cover 71, each of the pressure portions 83 confronts the corresponding shutter cover opening 73 formed in the shutter cover 71, and the pinching portion 85 confronts a left end portion of the shutter cover 71. Then, each of the holding portions 84 of the shift member 81 is inserted into the corresponding guide slit 74 formed in the shutter cover 71. Each of the holding portions 84 is engaged with a peripheral edge of the corresponding guide slit 74 to be fixed relative to the shutter cover 71. Consequently, as shown in FIG. 6A, the shift member 81 is supported to the casing 51 (toner cartridge 11).

Figure 6B:
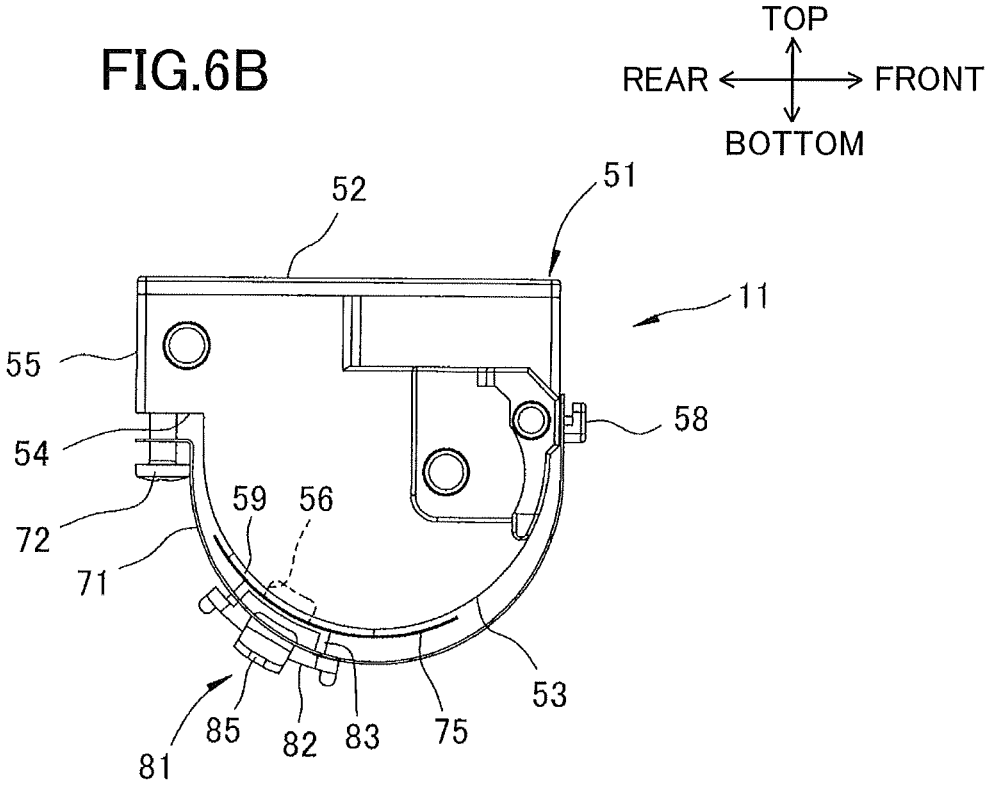
FIG. 6B is a left side view of the toner cartridge and the shift member shown in FIG. 6A.

In this state, each pressure portions 83 is inserted into the corresponding shutter cover opening 73 to press the corresponding toner seal 59 through the shutter 75. As a result, as shown in FIG. 6B, the shutter 75 is positioned at the second position in which the shutter 75 is relatively close to the casing 51, thereby compressing each of the toner seals 59. Therefore, a seal pressure of each toner seal 59 can be increased.

When the shift member 81 is detached from the toner cartridge 11 for mounting the toner cartridge 11 in the space 12, elasticity of the toner seals 59 restores the original shapes of the toner seals 59 shown in FIG. 4B, thereby moving the shutter 75 from the second position to the first position in which the shutter 75 is relatively far from the casing 51.

8. Operations and Effects (1) Operation and Effect 1

As described above, the toner cartridge 11 includes the casing 51 for accommodating toner therein. The casing 51 is formed with the cartridge communication holes 56 for providing communication between the interior and exterior of the casing 51. The toner cartridge 11 also includes the shutter 75 for opening or closing the cartridge communication holes 56. That is, the shutter 75 is provided so as to be movable between the open position for opening the cartridge communication holes 56 and the closed position for closing the cartridge communication holes 56. Further, the shutter 75 is provided so as to be shiftable between the first position relatively far from the casing 51 and the second position relatively close to the casing 51. When the shutter 75 is in the closed position, the toner seals 59 are interposed between the casing 51 and the shutter 75.

The toner cartridge 11 further includes the shift member 81. The shift member 81 shifts the shutter 75 from/to the first position to/from the second position while the shutter 75 is in the closed position.

In the first position, the shutter 75 is positioned relatively far from the casing 51. Accordingly, an amount of compression of each toner seal 59 interposed between the casing 51 and the shutter 75 is relatively low, and a seal pressure of each toner seal 59 is relatively low. Thus, because the shutter 75 is in the first position when the shutter 75 is moved between the open position and the closed position, a frictional force between the shutter 75 and the toner seals 59 is reduced, and therefore, a torque necessary for moving the shutter 75 can be reduced.

On the other hand, in the second position, the shutter 75 is positioned relatively close to the casing 51. Accordingly, the amount of compression of each toner seal 59 interposed between the casing 51 and the shutter 75 is relatively high, and a seal pressure of each toner seal 59 is relatively high. Thus, because the shutter 75 is in the second position when the toner cartridge 11 is transported, toner leakage through a position between the casing 51 and the shutter 75 can be reliably prevented even if the toner cartridge 11 is vibrated for a long period of time during transportation.

Therefore, toner leakage during transportation can be prevented, and besides, a torque necessary for moving the shutter 75 can be reduced.

(2) Operation and Effect 2

The shift member 81 includes the pressure portions 83 and the holding portions 84. When the holding portions 84 are held in the casing 51, the pressure portions 83 presses the shutter 75 to shift the shutter 75 to the second position from the first position. Hence, with such a simple configuration, the shutter 75 can be shifted to the second position from the first position.

(3) Operation and Effect 3

The shutter cover 71 is provided at a position opposite the casing 51 relative to the shutter 75. With this configuration, the shutter 75 is interposed between the casing 51 and the shutter cover 71. The shutter cover 71 is formed with the shutter cover openings 73 at positions confronting the cartridge communication holes 56. The pressure portions 83 press the shutter 75 through the shutter cover openings 73. Accordingly, the shutter 75 can be reliably pressed by the pressure portions 83.

(4) Operation and Effect 4

The shutter cover 71 is formed with the guide slits 74. The holding portions 84 are engaged with the guide slits 74 to be fixed thereto. Hence, the holding portions 84 are held relative to the casing 51. Therefore, such a simple configuration allows the holding portions 84 to be supported relative to the casing 51.

(5) Operation and Effect 5

The shutter 75 is formed of a resiliently deformable material. Hence, the shutter 75 can be deformed in conformance with the shape of casing 51 when the shutter 75 is shifted to the second position from the first position. Further, when the shutter 75 is shifted to the first position from the second position, the shutter 75 can restore its original shape.

9. Second Embodiment

FIGS. 7A, 7B, 8A, and 8B illustrate a toner cartridge 111 and a fixing member 101 as shift member according to a second embodiment of the present invention. With regard to a structure shown in FIGS. 7A, 7B, 8A, and 8B, only differences between the structure shown in FIGS. 7A, 7B, 8A, and 8B, and the structure shown in FIGS. 4A and 4B will be described below. Parts and components shown in FIGS. 7A, 7B, 8A, and 8B the same as those shown in FIGS. 4A and 4B are designated by the same reference numerals used in FIGS. 4A and 4B in order to avoid duplicating description.

(1) Structure

Figure 7A:
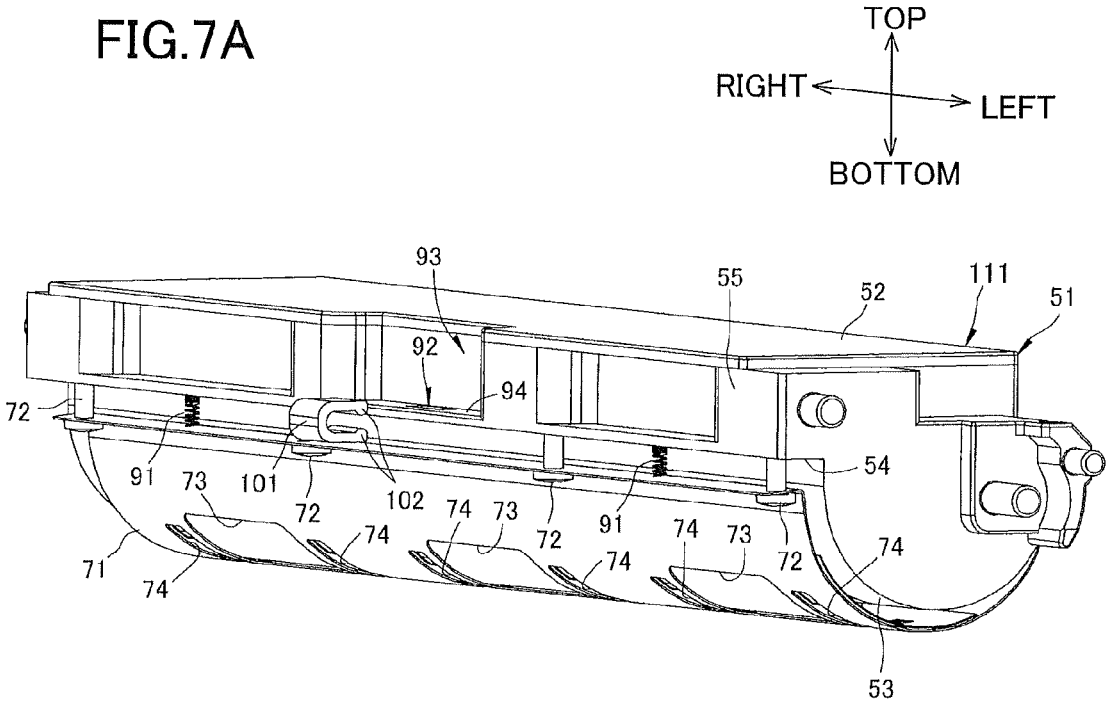
FIG. 7A is a perspective view of a toner cartridge and a fixing member according to a second embodiment of the present invention, wherein the fixing member is removed from the toner cartridge.
Figure 7B:
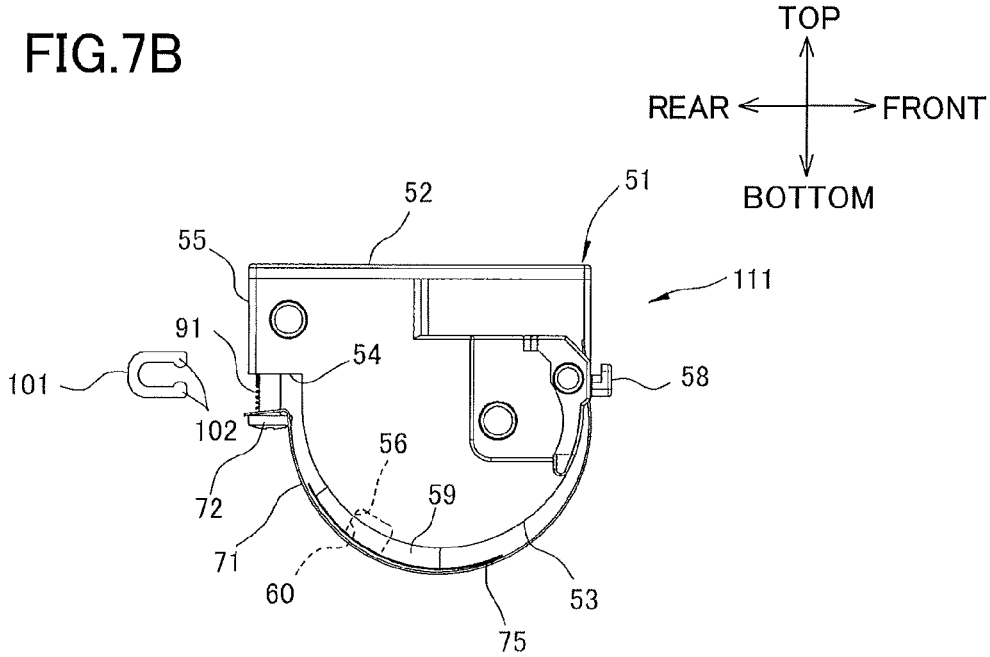
FIG. 7B is a left side view of the toner cartridge and the fixing member shown in FIG. 7A.

As shown in FIGS. 7A and 7B, a plurality of coil springs 91 is interposed between the fixing surface 54 of the casing 51 and the rear end portion of the shutter cover 71 confronting the fixing surface 54, while being compressed.

The rear surface 55 of the casing 51 of the toner cartridge 111 is formed with a recessed portion 93 formed in a square shape as viewed from a rear side. The recessed portion 93 has a portion 94 extending parallel to the fixing surface 54. The portion 94 is formed with a concave portion 92 depressed toward the fixing surface 54.

The toner cartridge 111 is accompanied with the fixing member 101 serving as the shift member and formed in a generally U-shape. The fixing member 101 is resiliently deformable. The U-shaped fixing member 101 has two free ends, each having a protrusion 102 that protrudes toward each other.

When the fixing member 101 has been removed from the toner cartridge 11, as shown in FIG. 7B, the shutter 75 is in a first position relatively far from the casing 51 by the urging force of the coil springs 91. Further, the shutter cover 71 is positioned at a weak pressure position that is relatively far from the casing 51. In the weak pressure position, the shutter cover 71 contacts the shutter 75 with a force such that the shutter cover 71 barely presses the shutter 75.

Figure 8A:
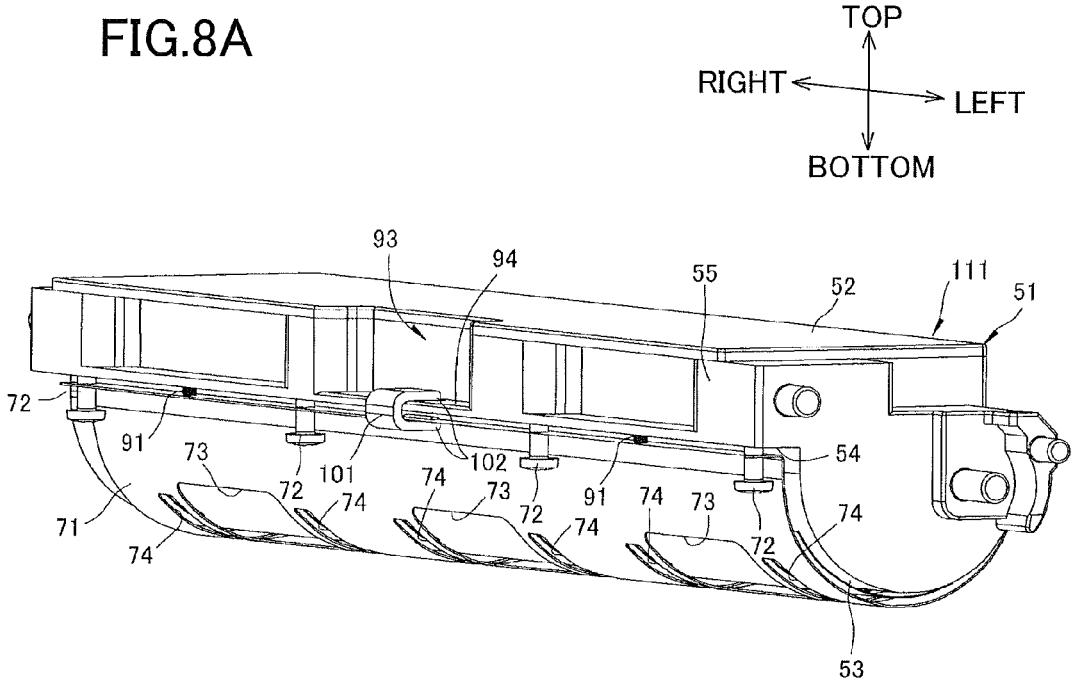
FIG. 8A is a perspective view of the toner cartridge and the fixing member shown in FIG. 7A, wherein the fixing member is attached to the toner cartridge.
Figure 8B:
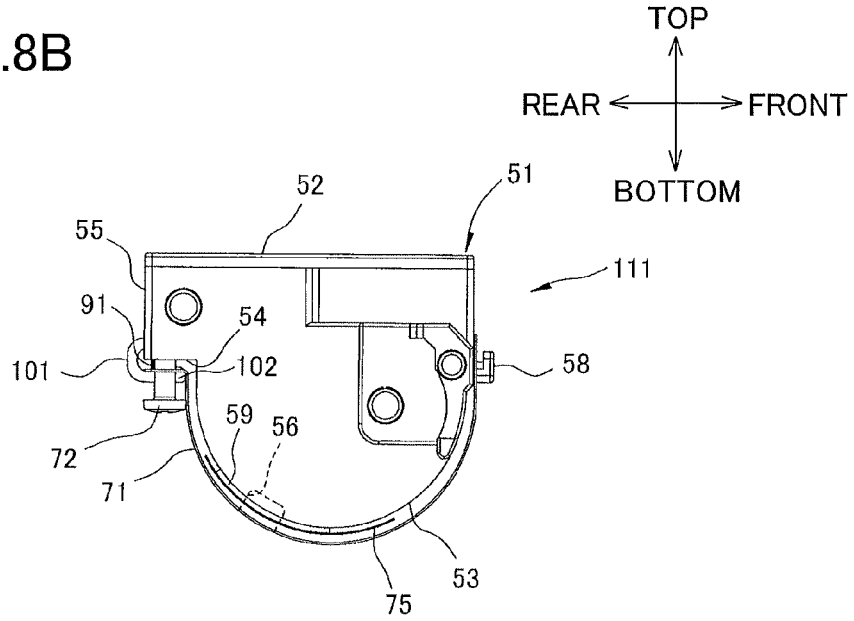
FIG. 8B is a left side view of the toner cartridge and the fixing member shown in FIG. 8A.

When fingers of the user pinch the portion 94 and the rear end portion of the shutter cover 71 to apply a force in a direction such that the rear end portion of the shutter cover 71 and the fixing surface 54 come closer to each other against the urging force of the coil springs 91, as shown in FIGS. 8A and 8B, the shutter cover 71 is resiliently deformed so as to reduce a radius of curvature of the shutter cover 71. Hence, the rear end of the shutter cover 71 approaches the fixing surface 54. As a result, the shutter cover 71 is moved from the weak pressure position to a strong pressure position that is relatively close to the casing 51 to provide a second position of the shutter 75. The shutter 75 is pressed by the shutter cover 71 toward the casing 51, and then, moved from the first position to the second position relatively close to the casing 51. Consequently, the toner seals 59 are compressed by the shutter 75, and a seal pressure of each toner seal 59 is increased.

In this state, the depressed portion 94 and the rear end portion of the shutter cover 71 are inserted between the free ends of the fixing member 101. Hence, one of the protrusions 102 of the fixing member 101 is brought into engagement with the concave portion 92, so that the shutter cover 71 is maintained at the strong pressure position.

When the fixing member 101 is removed from the toner cartridge 111 for mounting the toner cartridge 111 in the space 12, elasticity of the toner seals 59 restores the toner seals 59 to their original shapes shown in FIG. 7B. Further, the shutter 75 is moved from the second position to the first position relatively far from the casing 51. The shutter cover 71 is also moved from the strong pressure position to the weak pressure position with an assistance of the urging force of the coil springs 91.

(2) Operation and Effect 1

The shutter cover 71 is provided at a position opposite the casing 51 relative to the shutter 75. With this configuration, the shutter 75 is interposed between the casing 51 and the shutter cover 71. The shutter cover 71 is formed with the shutter cover openings 73 at positions confronting the cartridge communication holes 56. The shutter cover 71 is shiftable between the weak pressure position and the strong pressure position.

When the shutter cover 71 is in the weak pressure position, the shutter 75 positioned at the first position is pressed relatively weakly. An amount of compression of each toner seal 59 interposed between the casing 51 and the shutter 75 is relatively low, and a seal pressure of each toner seal 59 is relatively low.

When the shutter cover 71 is in the strong pressure position, the shutter 75 positioned at the second position is pressed relatively strongly. The amount of compression of each toner seal 59 interposed between the casing 51 and the shutter 75 is relatively high, and a seal pressure of each toner seal 59 is relatively high. Hence, by shifting the position of the shutter cover 71 to/from the weak pressure position from/to the strong pressure position, the seal pressure of each toner seal 59 can be easily changed.

(3) Operation and Effect 2

When the shutter cover 71 is in the strong pressure position, the fixing member 101 can fix the shutter cover 71 relative to the casing 51. Accordingly, the shutter cover 71 can be reliably maintained at the strong pressure position.

Incidentally, "the weak pressure position" includes a situation where no pressure force from the shutter cover 71 is applied to the shutter 75.

While the invention has been described in detail with reference to the embodiment thereof, it would be apparent to those skilled in the art that various changes and modifications may be made therein without departing from the scope of the invention.

What is claimed is:

1. A toner cartridge comprising:

a main body defining an internal space for accommodating toner and formed with a communication hole, through which the internal space is configured to communicate with a space external to the main body;

a shutter movable between an open position in which the communication hole is open and a closed position in which the communication hole is closed, the shutter also being shiftable between a first position in which the shutter is positioned away from the main body and a second position in which the shutter is positioned close to the main body, the movement of the shutter between the open position and the closed position being performed when the shutter is in the first position;

a toner seal disposed between the main body and the shutter when the shutter is in the closed position; and a shift member configured to shift the shutter from the first position to the second position when the shutter is in the closed position such that the shutter moves toward the communication hole in a direction perpendicular to a width direction of the main body.

2. The toner cartridge as claimed in claim 1, wherein the shift member comprises:

a holding portion configured to be supported to the main body; and a pressure portion configured to press the shutter to shift the shutter from the first position to the second position while the holding portion is supported to the main body.

3. The toner cartridge as claimed in claim 2, further comprising a shutter cover provided at a position opposite the main body relative to the shutter and formed with a cover opening at a position corresponding to the communication hole, the pressure portion pressing the shutter through the cover opening.

4. The toner cartridge as claimed in claim 3, wherein the shutter cover is provided with an engaged portion, and wherein the holding portion is engageable with the engaged portion, thereby being held to the main body.

5. The toner cartridge as claimed in claim 1, wherein the shutter is formed of a resilient material.

6. The toner cartridge as claimed in claim 1, further comprising a shutter cover provided at a position opposite the main body relative to the shutter and formed with a cover opening at a position corresponding to the communication hole, the shutter cover configured to be shiftable between a first pressure position in which the shutter cover presses the shutter in the first position with a relatively weak force and a second pressure position in which the shutter cover presses the shutter in the second position with a relatively strong force.

7. The toner cartridge as claimed in claim 6, wherein the shift member is a fixing member configured to fix the shutter cover relative to the main body when the shutter cover is in the second pressure position.

8. The toner cartridge as claimed in claim 1, wherein the shift member is detachable from or attachable to the main body.

9. The toner cartridge as claimed in claim 1, wherein the toner seal is elastically deformable.

10. A toner cartridge comprising:

a main body defining an internal space for accommodating toner and formed with a communication hole, through which the internal space is configured to communicate with a space external to the main body;

a shutter movable between an open position in which the communication hole is open and a closed position in which the communication hole is closed, the shutter also being shiftable between a first position in which the shutter is positioned away from the main body and a second position in which the shutter is positioned close to the main body;

a toner seal disposed between the main body and the shutter when the shutter is in the closed position;

a shift member configured to shift the shutter from the first position to the second position when the shutter is in the closed position, the shift member comprising:

a holding portion configured to be supported to the main body; and a pressure portion configured to press the shutter to shift the shutter from the first position to the second position while the holding portion is supported to the main body; and a shutter cover provided at a position opposite the main body relative to the shutter and formed with a cover opening at a position corresponding to the communication hole, the pressure portion pressing the shutter through the cover opening.

* * * * *